US007971822B1

(12) United States Patent
Crow

(10) Patent No.: US 7,971,822 B1
(45) Date of Patent: Jul. 5, 2011

(54) PIVOTAL YARN PACKAGE HOLDER

(76) Inventor: Mitchell A. Crow, Calhoun, GA (US)

( * ) Notice: Subject to any disclaimer, the term of this patent is extended or adjusted under 35 U.S.C. 154(b) by 411 days.

(21) Appl. No.: 12/150,409

(22) Filed: Apr. 28, 2008

(51) Int. Cl.
*B65H 49/38* (2006.01)

(52) U.S. Cl. ..... 242/591; 242/593; 242/597.3; 242/597.8; 242/130.1; 242/131

(58) Field of Classification Search ..... 242/591, 242/597.8, 597, 590, 593, 131, 131.1, 130.4, 242/130.1, 130, 474, 474.1, 474.2, 592, 597.3; 248/289.11, 292.12; 403/116
See application file for complete search history.

(56) References Cited

U.S. PATENT DOCUMENTS 3,915,406 A * 10/1975 Rolli et al. ..... 242/131
4,023,747 A * 5/1977 Champagne ..... 242/130
4,880,184 A * 11/1989 Crow ..... 242/130

* cited by examiner

*Primary Examiner* — William E Dondero
(74) *Attorney, Agent, or Firm* — Rodgers & Rodgers

(57) ABSTRACT

A yarn package holder including a support post, a latch block coaxially disposed on the support post and selectively rotatable thereon, a rotatable support block coaxially disposed on the support post above the latch block, a cone holder extending laterally from the support block, a collar coaxially disposed on the support post above the support block and selectively rotatable thereon and stop means extending upwardly from the support block and cooperating with a stop extension extending from the collar to stop rotation of the support block.

7 Claims, 2 Drawing Sheets

PIVOTAL YARN PACKAGE HOLDER

BACKGROUND OF THE INVENTION

Creels are well known for supporting a plurality of packages of yarn for use in connection with yarn processing. It is also well known to pivot a yarn package from a use position to a replacement position so that the used yarn package can be replaced with a new yarn package which is then returned to its use position. The yarn packages are manually pivoted in each direction which utilizes valuable operator time. Therefore, it is desirable that the yarn package rotate from its use position to its replacement position and vice versa in an efficient and reliable manner.

BRIEF SUMMARY OF THE INVENTION

By this invention, yarn package support means includes a cone holder for receiving a yarn package which is rotatable about a fixed axis and means selectively locking the cone holder to a latch block and the latch block being selectively rotatable about an axis and being held in place by means of a collar. The cone holder is secured to a support block which is manually rotatable from a use position to a position for replacing an empty yarn package with a full yarn package and means to stop rotation of the cone holder in either direction including stop means disposed above the support block and a cooperating stop extension extending from the collar.

DETAILED DESCRIPTION OF THE INVENTION

Figure 1:
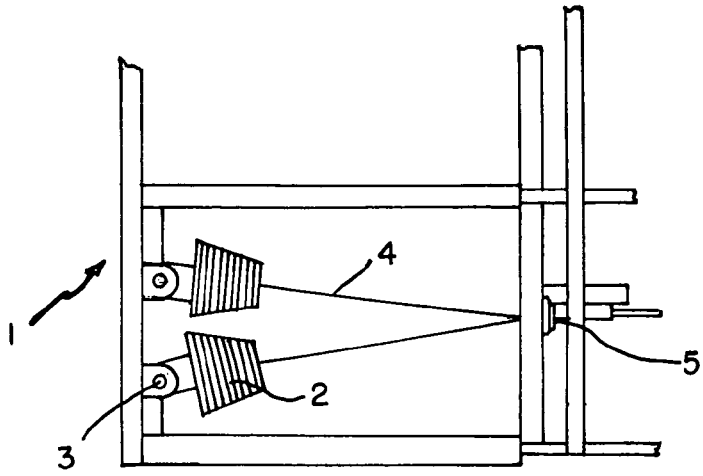
FIG. 1 is a top plan view of a portion of a creel.

In the drawings and with particular reference to FIG. 1, the numeral 1 generally designates a creel including multiple yarn packages 2 mounted on support means 3. Yarn 4 extends from each yarn package 2 across creel 1 and through eyelet 5 wherein it is directed to a yarn processing operation, as is well known.

Figure 3:
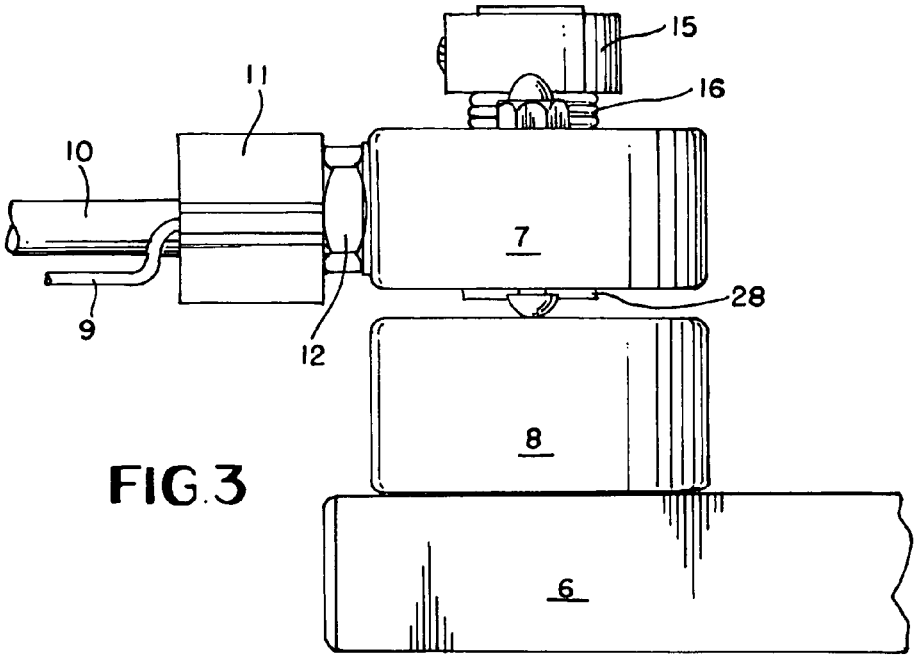
FIG. 3 is an enlarged side elevational view depicting the yarn package support means.
Figure 4:
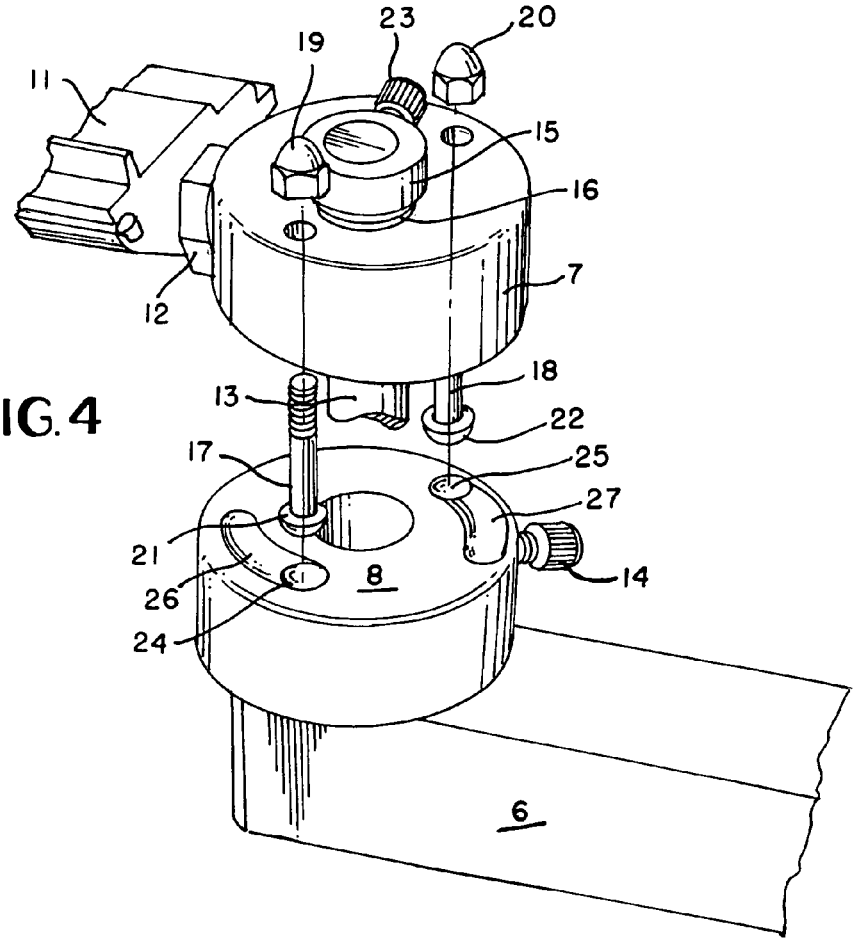
FIG. 4 is an enlarged exploded view showing the yarn package support means according to this invention.

Details of the yarn package support means, according to this invention, are best shown in FIG. 4 wherein mounting arm 6 is fixed, at one end, to creel 1 and includes, at the other end, support block 7 with latch block 8 coaxially disposed therebelow. As shown in FIG. 3, cone holder 9 includes rod 10 with bracket 11 fixed thereto and with bracket 11 secured to support block 7 by means of nut and washer assembly 12. Yarn packages 2 fit over cone holders 9 and are frictionally held in place, as is known in the art. Support block 7 is rotatable about support post 13 and latch block 8 is selectively fixed in position with respect to support post 13 by means of set screw 14. Support post 13 extends coaxially through support block 7 and latch block 8 and is suitably fixed to mounting arm 6.

Stop collar 15 is disposed above support block 7 and is coaxially disposed on the upper end of support post 13 and fixed thereto. Spring biasing means 16 is coaxially disposed between stop collar 15 and support block 7 and acts to bias support block 7 in a downward direction. Therefore, by this means, support block 7, together with cone holder 9, is freely rotatable about support post 13.

According to this invention, diametrically opposed screws 17 and 18 extend through support block 7 and are secured thereto, respectively, by means of kernel nuts 19 and 20. Heads 21 and 22 respective of screws 17 and 18 are disposed opposite kernel nuts 19 and 20 and are rounded in configuration, as best shown in FIG. 4. Also, according to this invention, set screw 23 extends outwardly from rotatable stop collar 15 and acts to fix stop collar 15 in position on support post 13. Finally, detents 24 and 25 are formed on the upper surface of latch block 8.

Figure 2:
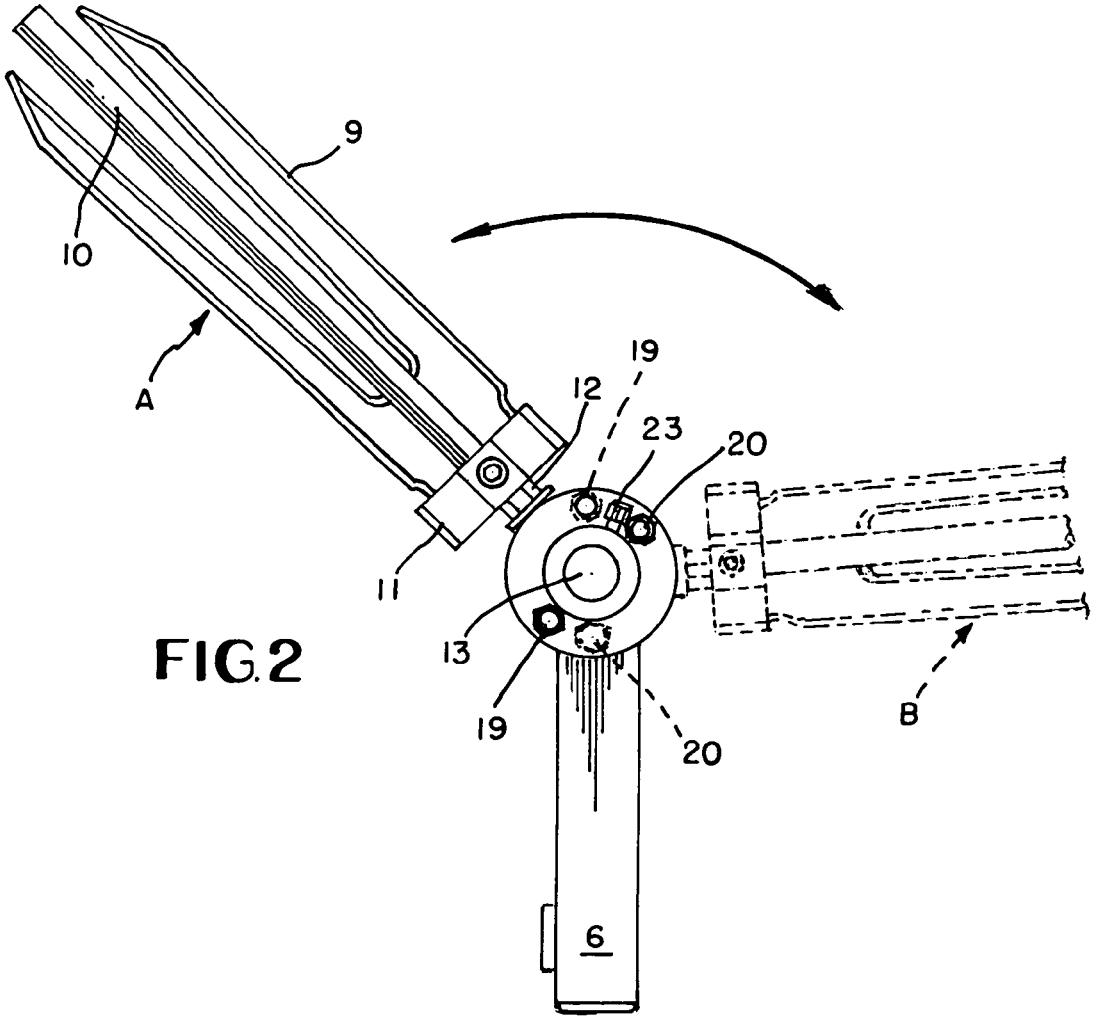
FIG. 2 is a top plan view showing rotation of the yarn package support means.

In operation and in accordance with conventional practice, when it is necessary to replace an empty yarn package 2, the operator simply swings yarn package 2, mounted on cone holder 9, through an arc from use position A, shown in FIG. 2, to load position B. As yarn package 2 swings from use position A around to load position B, support block 7 rotates about support post 13 causing stop means in the form of kernel nuts 19 and 20 to rotate until kernel nut 19 comes into contact with a stop extension in the form of coplanar horizontally projecting set screw 23 thereby ceasing rotation of yarn package 2. At position B, the operator removes the old yarn package and replaces it with a new yarn package 2 on cone holder 9 and then the mechanism is manually rotated from load position B back to use position A thereby causing kernel nut 20 to come into contact with the opposite side of set screw 23 to cease rotation of yarn package 2 at position A.

As yarn package 2 is moved to use position A, rounded heads 21 and 22 are caused, simultaneously, to enter detents 24 and 25, respectively. Therefore, in use position A, yarn package 2 is stopped in a precise location and is held firmly in position by means of the cooperation between kernel nut 20 and set screw 23. By employing rounded heads 21 and 22 disposed in the associated detents 24 and 25, additional holding means is provided to maintain yarn package 2 in the desired position A.

Although this invention would work equally as well with only one rounded head and detent combination, due to the weight of yarn packages 2, the tendency of support block 7 to tilt somewhat is eliminated when two rounded head and detent combinations are employed. If the operator desires to change the angle of cone holder 9 and mounting arm 6 so as to change the location of use position A and load position B, it is simply necessary to loosen set screw 23 and rotate support block 7 to the desired position and then tighten set screw 23 to relock support block 7 onto support post 13. By loosening set screw 14, latch block 8 is similarly rotated in order to properly align detents 24 and 25, respectively, with rounded heads 21 and 22.

Another advantage of this invention results from the fact that screws 17 and 18 are manufactured of metal which is harder than the metallic composition of latch block 8. Therefore, over a period of time and multiple cycles of use, the repeated pivoting action of rounded heads 21 and 22 causes curved grooves 26 and 27 to form on the upper surface of latch block 8. The depth of the grooves is limited by bearing 28 which will ultimately come into contact with the upper surface of latch block 8 and thereby prevent any further grooving. By this means, advantageously, when grooves 26 and 27 are fully formed, rotation of yarn package 2 from position A to position B and vice versa is smooth without the drag or resistance which would be inherent in the holder in the absence of grooves 26 and 27.

Therefore, by this invention, the time required to replace yarn packages is substantially reduced and, in the use position, the holders are held securely in position without the possibility of a yarn package rotating to a degree away from its proper position.

The invention claimed is:

1. A yarn package holder comprising a cone holder secured to a support block and extending outwardly therefrom, said support block having a lower surface and being selectively rotatable with respect to a latch block disposed coaxially therebelow, a collar disposed above said support block and being selectively fixed in position with respect to said support block, a detent formed in the upper surface of said latch block, a screw extending through said support block and being secured in place by a stop, a stop extension extending outwardly from said collar, said stop and said stop extension being disposed generally in the same horizontal plane, the composition of said screw being harder than the composition of said latch block, the head of said screw opposite said stop being rounded, a curved groove formed in said upper surface of said latch block by repeated pivoting action of said rounded head, and said curved groove extending from said detent.

2. A yarn package holder according to claim 1 wherein a pair of screws extend through said support block.

3. A yarn package holder according to claim 1 wherein a pair of detents are formed on the upper surface of said latch block.

4. A yarn package holder according to claim 1 wherein said stop comprises a kernel nut.

5. A yarn package holder according to claim 1 wherein said stop extension comprises a set screw.

6. A yarn package holder according to claim 1 wherein said support block is rotatable about a support post and a bearing is coaxial with respect to said support post.

7. A yarn package holder according to claim 1 wherein a bearing extends from said lower surface of said support block intermediate said support block and said latch block.

* * * * *